US011819181B2

(12) United States Patent
Pruiett

(10) Patent No.: US 11,819,181 B2
(45) Date of Patent: Nov. 21, 2023

(54) VACUUM CLEANER AND DUST PLUME REDUCTION APPARATUS

(71) Applicant: BISSELL Inc., Grand Rapids, MI (US)

(72) Inventor: Jason W. Pruiett, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 204 days.

(21) Appl. No.: 17/380,454

(22) Filed: Jul. 20, 2021

(65) Prior Publication Data

US 2021/0345845 A1 Nov. 11, 2021

Related U.S. Application Data

(63) Continuation of application No. 16/432,487, filed on Jun. 5, 2019, now Pat. No. 11,089,930.

(60) Provisional application No. 62/687,455, filed on Jun. 20, 2018.

(51) Int. Cl.

| | |
|---|---|
| ***A47L 9/16*** | (2006.01) |
| ***A47L 5/22*** | (2006.01) |
| ***A47L 9/02*** | (2006.01) |
| ***A47L 9/10*** | (2006.01) |

(52) U.S. Cl.

CPC ..... *A47L 9/1683* (2013.01); *A47L 5/22* (2013.01); *A47L 9/02* (2013.01); *A47L 9/102* (2013.01)

(58) Field of Classification Search

CPC . A47L 9/1683; A47L 5/22; A47L 9/02; A47L 9/102

See application file for complete search history.

(56) References Cited

U.S. PATENT DOCUMENTS

| | | | | |
|---|---|---|---|---|
| 8,978,199 | B2 * | 3/2015 | Kasper | A47L 9/104 15/353 |
| 10,244,910 | B2 * | 4/2019 | Conrad | A47L 9/106 |
| 2015/0289738 | A1 * | 10/2015 | Tran | A47L 9/1633 15/353 |
| 2017/0196430 | A1 * | 7/2017 | Machida | A47L 9/1683 |
| 2019/0387939 | A1 * | 12/2019 | Pruiett | A47L 9/1641 |
| 2021/0345845 | A1 * | 11/2021 | Pruiett | A47L 9/22 |

FOREIGN PATENT DOCUMENTS

| | | | | |
|---|---|---|---|---|
| AU | 2014100077 A4 | | 2/2014 | |
| CN | 102670124 A | * | 9/2012 | A47L 5/24 |
| GB | 2526949 A | * | 12/2015 | A47L 5/24 |

OTHER PUBLICATIONS

European Patent Office, European Search Report re Application No. 19180163.8-1018, dated Nov. 8, 2019, 8 pages, Munich, Germany.

* cited by examiner

*Primary Examiner* — Marc Carlson

(74) *Attorney, Agent, or Firm* — McGarry Bair PC

(57) ABSTRACT

A dirt collection and separation module can include a suction air flow around the perimeter of a tank to ingest fine dust that becomes airborne during the emptying process. Additionally, a trash can suction nozzle around a rim, a hand vacuum docking station, and an auxiliary suction nozzle that can fluidly couple the hand vacuum.

20 Claims, 11 Drawing Sheets

VACUUM CLEANER AND DUST PLUME REDUCTION APPARATUS

CROSS-REFERENCE TO RELATED APPLICATION

This application is a continuation of U.S. patent application Ser. No. 16/432,487, filed Jun. 5, 2019, now U.S. Pat. No. 11,089,930, issued Aug. 17, 2021, which claims the benefit of U.S. Provisional Patent Application No. 62/687,455, filed Jun. 20, 2018, all of which are incorporated herein by reference in their entirety.

BACKGROUND

Vacuum cleaners can be embodied as upright units or portable, hand-carriable units. In some instances, a vacuum cleaner can be reconfigurable between an upright cleaning mode and a lift-off mode in which a smaller pod or hand-carriable unit is removed from the vacuum cleaner for use in a cleaning operation.

Vacuum cleaners employ a variety of dirt separators to remove dirt and other debris from a working airstream. Some dirt separators use one or more frusto-conical-shaped separator(s) and others use high-speed rotational motion of the air/dirt to separate the dirt by centrifugal force. Before exiting the dirt separator, the working air may flow through an exhaust grill.

A dirt collector can be provided for collecting the removed dirt from the working airstream, and can be separate from or integral with the dirt separator. In vacuum cleaners where the dirt separator and collector are separate, the dirt collector can be removable from the vacuum cleaner for emptying collected dirt, without removing the dirt separator. In vacuum cleaners where the dirt separator and collector are integral, the entire separator/collector assembly can be removable from the vacuum cleaner for emptying collected dirt. In this case, a bottom wall of the assembly often serves as a dirt door, and is provided with a release mechanism for opening the dirt door to empty the accumulated contents.

Dirt separators may not remove all dirt from the working airstream. Furthermore, swirling air currents in the dirt collector may cause separated dirt to be re-entrained in the working airstream. Still further, when removing the dirt collector from the vacuum cleaner and emptying the accumulated contents, plumes of fine dust may be released from the dirt collector.

BRIEF SUMMARY

An aspect of the present disclosure relates to vacuum cleaner, comprising a suction nozzle, a suction source fluidly connected to the suction nozzle and configured to create a working airstream, and a separation module configured for separating contaminants from the working airstream, the separation module, comprising, a separation module housing, a door rotatably coupled to the separation module housing, wherein the door rotates between a closed position wherein the door at least partially defines a bottom surface of the separation module housing, and an opened position wherein debris can be emptied, and at least one damper operably coupled with the door and configured to reduce a speed of the door moving to the opened position as compared to an undamped door.

Another aspect of the present disclosure relates to a separation module configured for separating contaminants from a working airstream, the separation module, comprising a separation module housing, a carry handle provided on the separation module housing, a door, pivotally-mounted to a lower end of the housing, the door moveable between a closed position wherein the door at least partially defines a bottom surface of the separation module housing, and an opened position wherein debris can be emptied, at least one damper operably coupled with the door, the at least one damper configured to reduce a speed of the door as the door moves to the opened position as compared to an undamped door, and a release mechanism configured to releasably engage the door with the separation module housing.

DETAILED DESCRIPTION

Aspects described herein relate to vacuum cleaners, and in particular to vacuum cleaners and accessories configured to reduce dust plume.

In one aspect, a dirt collection and separation module has a suction air flow around the perimeter of the module to ingest fine dust that becomes airborne during the emptying process.

In another aspect, a trash can includes a suction nozzle, a hand vacuum docking station, and an auxiliary suction nozzle that can fluidly couple the hand vacuum.

In yet another aspect, a dirt collection and separation module has an auxiliary suction nozzle around the perimeter of the module and an air diverter valve configured to divert air from a separator inlet and the auxiliary suction nozzle.

In yet another aspect, a dirt collection and separation module includes rotational dampers on a door hinge to slow the speed of the door opening during an emptying process to reduce dust plume.

Figure 1:
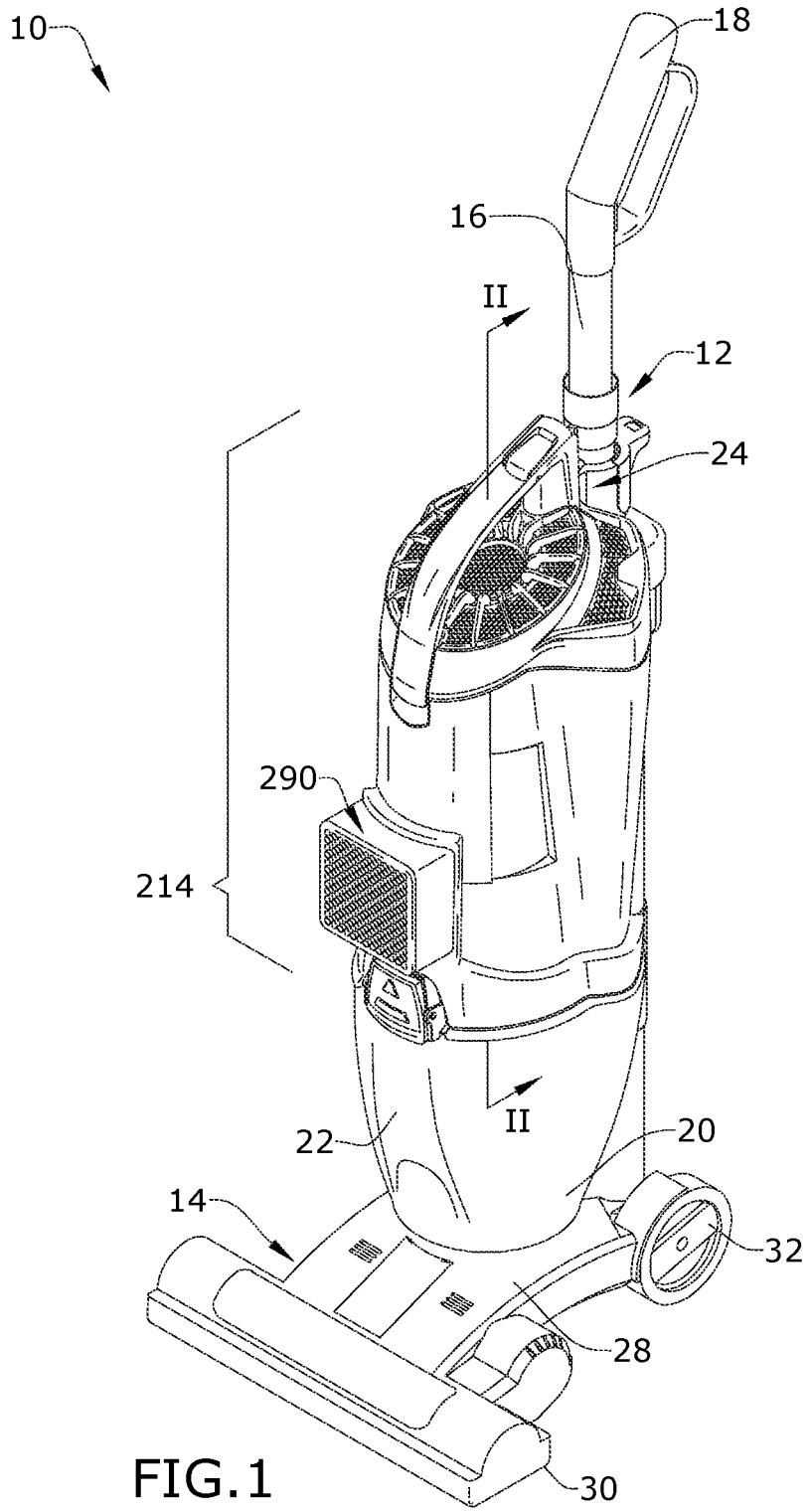
FIG. 1 is a perspective view of a vacuum cleaner having a separation module according to various aspects described herein.

Referring to the drawings, and in particular to FIG. 1, an upright vacuum cleaner 10 includes an upright handle assembly 12 pivotally mounted to a foot assembly 14. The handle assembly 12 further includes a primary support section 16 with a grip 18 on one end to facilitate movement by a user. A motor cavity 20 is formed at an opposite end of the handle assembly 12 to contain a conventional suction source such as a vacuum fan/motor assembly (not shown) therein. A post-motor filter housing 22 is also provided on the handle assembly 12 and is in fluid communication with the vacuum fan/motor assembly.

The handle assembly 12 pivots relative to the foot assembly 14 through a pivot axis that is coaxial with a motor shaft (not shown) associated with the vacuum fan/motor assembly. Alternatively, the handle assembly 12 can be coupled to the foot assembly 14 by a multi-axis joint.

A mounting section 24 on the primary support section 16 of the handle assembly 12 can receive a collection system 214 for separating and collecting contaminants from a working airstream for later disposal. In one conventional arrangement illustrated herein, the collection system 214 is shown as a cyclone separation module. However, it is understood that other types of separation modules can be used, such as centrifugal separators or bulk separators. The vacuum cleaner 10 can also be provided with one or more additional filters upstream or downstream of the collection system 214.

The foot assembly 14 includes a housing 28 with a suction nozzle 30 formed at a lower surface thereof and that is in fluid communication with the vacuum fan/motor assembly. While not shown, an agitator can be positioned within the housing 28 adjacent the suction nozzle 30 and operably connected to a dedicated agitator motor, or to the vacuum fan/motor assembly within the motor cavity 20 via a stretch belt as is common in the vacuum cleaner art. Rear wheels 32 are secured to a rearward portion of the foot assembly 14 and a pair of support wheels (not shown) is secured to a forward portion of the foot assembly 14 for moving the foot assembly 14 over a surface to be cleaned.

Figure 2:
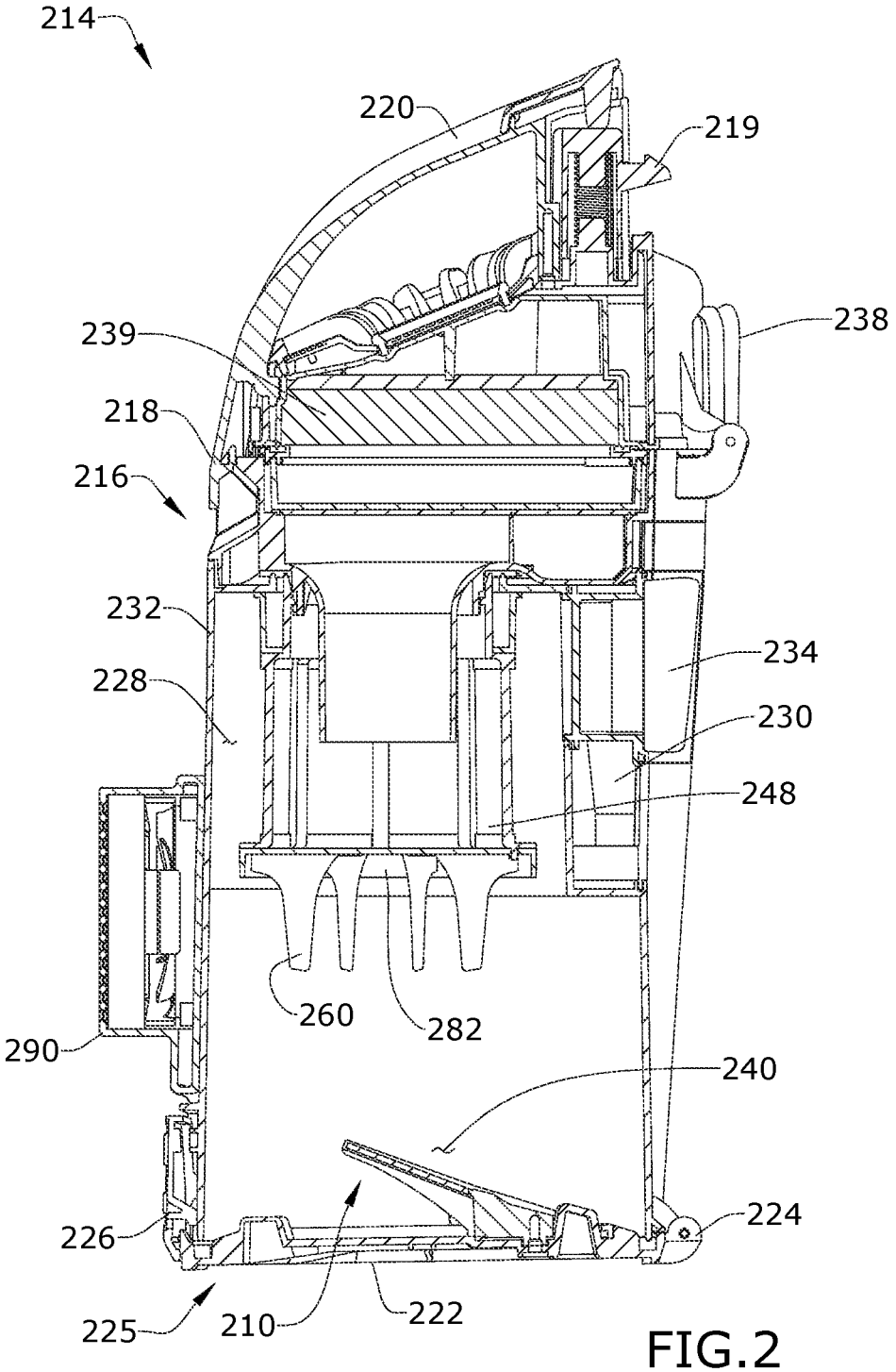
FIG. 2 is a sectional view of the separation module taken through line II-II of FIG. 1.

FIG. 2 is a cross-sectional view through line II-II of FIG. 1. The separation module 214 includes a housing 216 with an outer cover 218 having a carry handle 220 located on an upper portion of the housing 216. The carry handle 220 can carry a latch 219 that releasably secures the separation module 214 to the vacuum cleaner 10 (FIG. 1). The separation module 214 further has a pivotally-mounted bottom door 222 that is attached to the lower end of the housing 216 by a hinge 224. When the separation module 214 is removed from the vacuum cleaner, the debris collected therein can be emptied by releasing the bottom door 222. A pivoting lever 226 that releasably engages the bottom door 222 for selectively opening the bottom door 222 and emptying the housing 216 is provided opposite the hinge 224.

The housing 216 can define a primary separation stage with a primary separation chamber 228, and a secondary separation stage with a plurality of secondary cyclone separators 230. While FIG. 2 illustrates only one secondary cyclone separator 230, there can be two or more secondary cyclone separators 230. The primary separation chamber 228 is defined by a generally cylindrical primary separator sidewall 232 of the housing 216 which extends generally along a central longitudinal axis of the module 214. A working air inlet 234 to the primary separation chamber 228 is formed in an upper portion of the sidewall 232 and communicates with a helical air inlet passage leading to the primary separation chamber 228. The air inlet 234 is in fluid communication with the suction nozzle 30 (FIG. 1) when the separation module 214 is mounted to the vacuum cleaner 10.

A grill assembly 248 can be fluidly positioned downstream of the primary separation chamber 228 and upstream of the secondary cyclone separators 230. The grill assembly 248 can optionally include a support frame and a mesh screen wrapped around the support frame.

A working air flow path extends through the module 214, from the inlet 234 to an air outlet 238. The air outlet 238 is in fluid communication with the vacuum fan/motor assembly in the cavity 20 (FIG. 1) when the separation module 214 is mounted to the vacuum cleaner 10. After entering the inlet 234, working air sequentially travels through the primary separation chamber 228, the grill assembly 248, the secondary cyclone separators 230, and optionally through an exhaust filter 239, prior to exiting through the air outlet 238.

Figure 4:
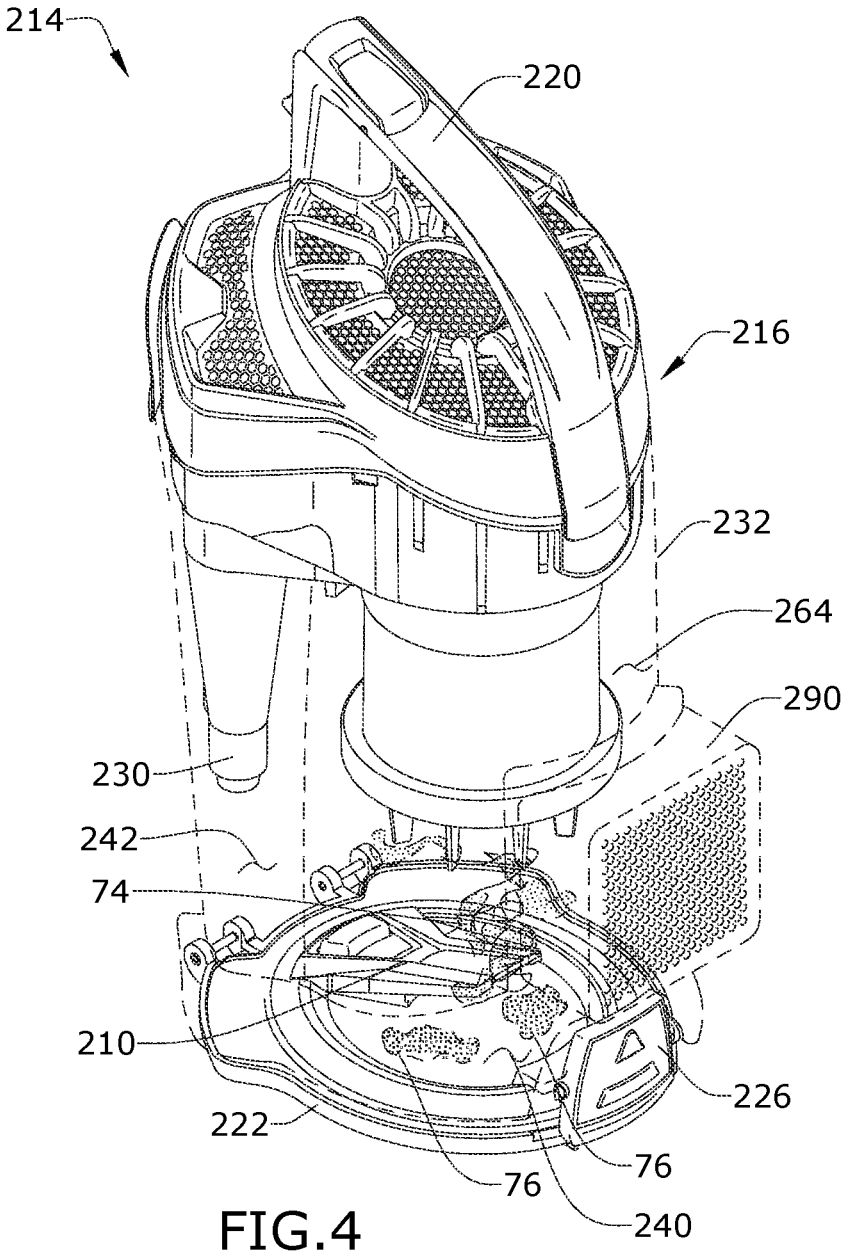
FIG. 4 is a perspective view of the separation module from FIG. 1 with a portion of the separation module shown in phantom line to illustrate the collection of debris in the separation module during operation.

Debris that is separated by the primary separation chamber 228 collects at the bottom of the housing 216 in a first collection chamber 240. Debris separated by the secondary cyclone separators 230 collects in one or more second collection chambers 242 (FIG. 4). Two collection chambers 242 can be provided, and each collection chamber 242 receives debris from a secondary cyclone separator 230 provided on the exterior of the sidewall 232, although other configurations of collection chambers and separators are possible. In one example, the two collection chambers 242 are spaced around the perimeter of the sidewall 232. Each collection chamber 240, 242 is open at their bottom edge, and are collectively closed by the door 222, which, when closed, forms the bottom of the collection chambers 240, 242.

The separation module 214 can further include a plurality of debris catching tines 260 which can depend downwardly from the grill assembly 248 and extend downwardly into the collection chamber 240. The tines 260 can include free terminal ends. The terminal ends of the tines 260 are spaced from the bottom door 222 of the housing 216. The tines 260 are oriented vertically, i.e. parallel to a central axis of the separation module 214.

A debris guard 282 can be mounted beneath the grill assembly 248, within the circular grouping of tines 260 to prevent debris from becoming lodged and stuck between the tines 260 and the grill assembly 248. In one example, the debris guard 282 is flat. However, the debris guard 282 can include other shapes, such as a convex or dome-shaped member in the center of the grouping of tines 260, concave or a combination thereof, for example.

In addition to the vertical tines 260, the separation module 214 can further include a second debris catching tine 210, or tines, on the bottom door 222 of the housing 216. The debris catching tine 210 can be configured to collect elongated debris, such as hair, in the collection chamber 240. More specifically, the tine 210 can be located on the bottom door 222 and extend upwardly into the collection chamber 240 to free terminal ends of the tines 260, which are below the collection chamber 228. The tine 210 can be oriented at an acute angle to the door 222, i.e. non-parallel to the inner surface of the door 222. The tine 210 can be made from metal or plastic.

Figure 3:
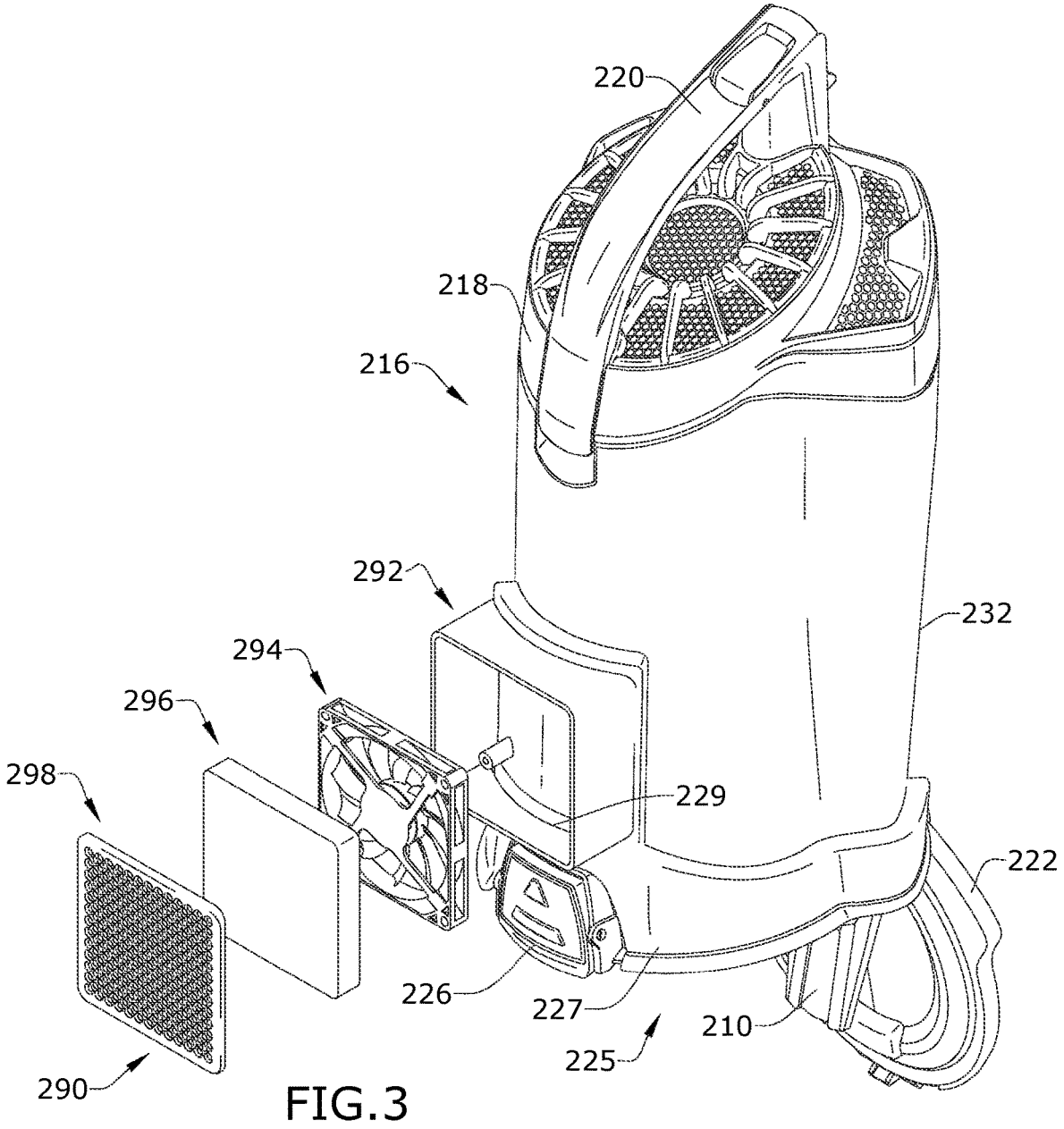
FIG. 3 is an exploded perspective view of the separation module of FIG. 1, illustrating an auxiliary suction fan of the separation module.

An auxiliary suction fan assembly 290 can be provided on the housing 216, such as on the sidewall 232, and can be in fluid communication with an auxiliary suction nozzle 225. FIG. 3 illustrates the auxiliary suction fan assembly 290 in greater detail. The suction fan assembly 290 can include a duct 292 provided on the outside of the sidewall 232 of the housing 216 that is in fluid communication with the auxiliary suction nozzle 225.

A suction conduit 227 can be disposed on the sidewall 232 of the housing and can be in fluid communication with or form the auxiliary suction nozzle 225. As shown herein, the suction nozzle 225 can define an inlet to the suction conduit 227, and can be formed as one or more openings disposed around the bottom perimeter of the housing 216. The suction conduit 227 can be integrally formed with the housing 216, and may extend at least partially around the bottom perimeter of the housing 216. An outlet 229 of the suction conduit 227 can be provided within the duct 292 to fluidly couple the auxiliary suction nozzle 225 with the duct 292. The suction conduit outlet 229 can be formed as an opening between the duct 292 and the sidewall 232.

A fan 294 is received within the duct 292 for creating a suction within the suction conduit 227. A filter 296 can be provided adjacent the fan 294, such as on the downstream side of the fan 294, and a cover 298 can be disposed over the filter 296 in order to retain the fan 294 and filter 296 within the duct 292. Additionally, the fan 294 can be retained within the duct 292 with fasteners, such as screws and the like. The cover 298 can include a plurality of openings or apertures, such as a mesh screen as shown, that are configured to allow airflow out of the suction fan assembly 290.

In one example, the pivoting lever 226 can be electrically coupled with the suction fan assembly 290 such that the fan 294 can be energized automatically when the door 222 is opened. This is advantageous, as the fan 294 will be automatically energized when the module 214 is being emptied.

FIG. 4 is a perspective view of the separation module 214, illustrating the collection of debris in the separation module 214 during operation. In operation, debris is collecting within the collection chambers 240, 242, and may include string-like or elongated debris 74 retained on the tines 260, 210 and particle-like debris 76, such as dirt, collected at the bottom of the collection chambers 240, 242.

Figure 5:
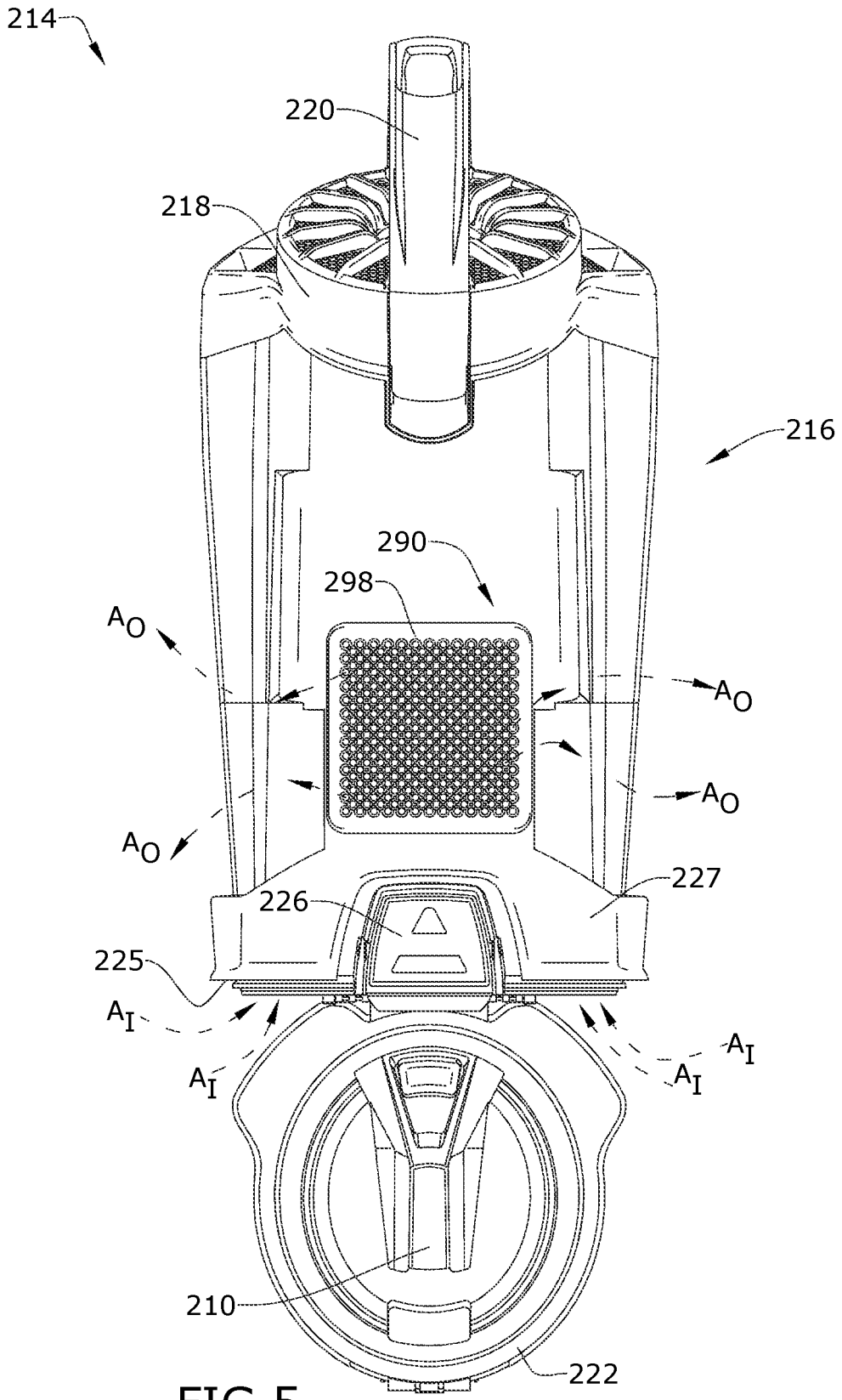
FIG. 5 is a front view of the separation module of FIG. 1 with a door in an open position and illustrating air flow through the separation module.

Turning to FIG. 5, when the separation module 214 is emptied, the door 222 is opened and particle-like debris 76 (FIG. 4) falls out of the open bottoms of collection chambers 240, 242. When the door 222 is fully open, the debris 74 sheds or falls off the tines 260, 210, although a user can shake or manually wipe off the tines 260, 210 if necessary. Furthermore, the particle-like debris 76, such as dirt or dust, can form a dust plume as the door 222 is opened.

Activation of the fan assembly 290 during emptying draws airflow into the auxiliary suction nozzle 225 formed by the suction conduit 227, as shown by arrows $A_I$. In one example, when the pivoting lever 226 is pressed to open the door 222, a power switch for the fan 294 can be actuated. The power switch can be configured to be a momentary switch or a push-push on/off switch. The airflow $A_I$ can draw debris 76 that has formed a dust plume into the suction nozzle 225 and through the duct 292 via the suction conduit outlet 229 (FIG. 3) where it can be captured by the filter 296. The filtered airflow then exits through the cover 298, as shown by arrows $A_O$.

The cover 298 can be removable in order to access the filter 296. For example, a user may desire to remove the filter 296 periodically in order to wash the entrained debris 76 away and clean the filter 296. Alternatively, the filter 296 can be disposable and replaceable.

Figure 6:
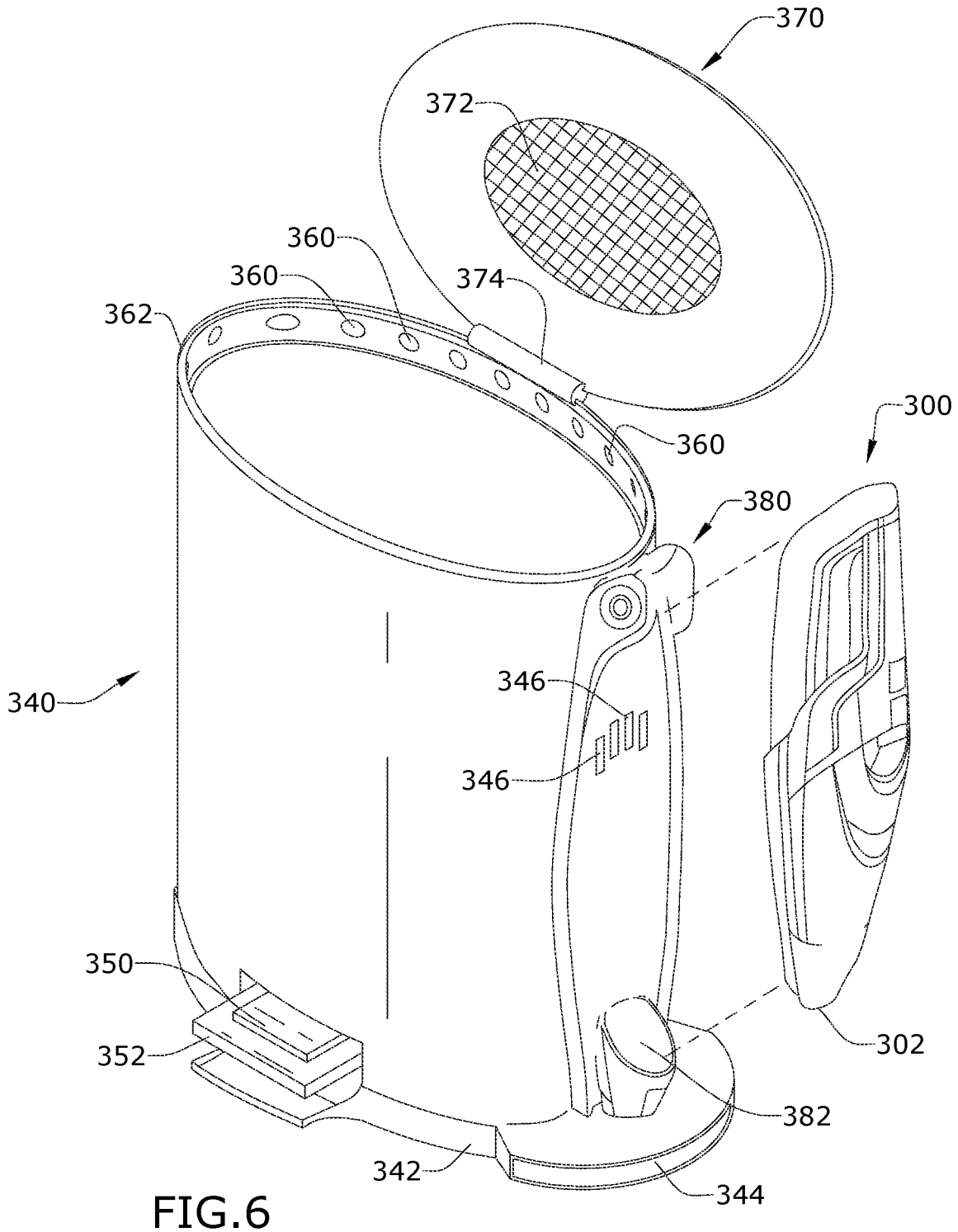
FIG. 6 is a perspective view of a trash can docking station according to various aspects described herein.

FIG. 6 illustrates a trash can 340 having a docking station 380 for a hand vacuum 300. The docking station 380 can also function as a charging base where charging contacts 346 on the docking station 380 can mate with charging contacts (not shown) on the hand vacuum 300 to electrically couple the hand vacuum 300 with the trash can 340. The trash can 340 can further be connected to a power source (not shown) such as a battery, or a household power supply, such as a wall outlet, and can include a converter for converting the AC voltage into DC voltage for recharging a power supply on-board the hand vacuum 300.

The trash can 340 can include a lid 370 that is pivotable between an open and closed position by a hinge 374. The lid 370 can be operably coupled with a foot pedal 352 on the trash can 340 for hands-free opening of the lid 370. The lid 370 can include a fragrance/ozone emitter 372 for controlling odors from within the trash can 340.

The trash can 340 can further include a plurality of suction ports 360 in fluid communication with the docking station 380. The suction ports 360 can form an auxiliary suction nozzle that can be in fluid communication with the hand vacuum 300 via a conduit or plenum (not shown) when the hand vacuum 300 is docked in the docking station 380. The suction ports 360 can draw airflow when the suction motor (not shown) of the hand vacuum 300 is actuated. The docking station 380 includes a docking port 382 configured to mate with a suction nozzle inlet 302 of the hand vacuum 300 when the hand vacuum 300 is docked. The docking port 382 is in fluid communication with the suction ports 360 via the conduit or plenum (not shown).

In one example, a raised upper portion 350 of the foot pedal 352 can actuate the suction motor when depressed. The foot pedal 352 can open the lid 370 by depression of the foot pedal 352 without actuating the suction motor in the event that the upper portion 350 is not simultaneously depressed.

The suction ports 360 can be disposed on or near a rim 362 at a top perimeter of the trash can 340. The docking port 382 can be disposed at or near or lower end of the docking station 380.

Figure 7:
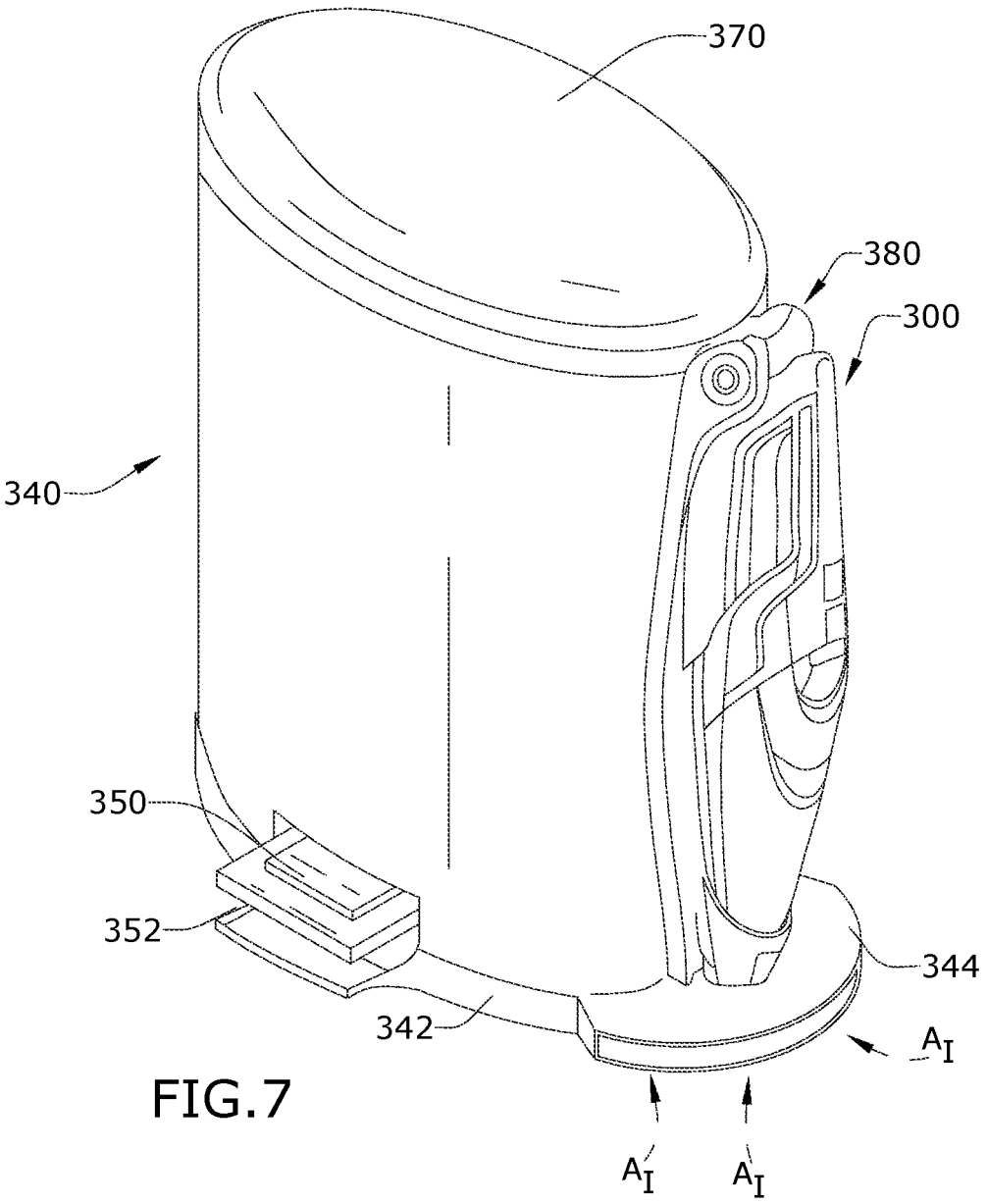
FIG. 7 is a perspective view of the trash can docking station of FIG. 6 with a hand vacuum docked thereon and illustrating air flow into the docking station.

Furthermore, a bottom perimeter 342 of the trash can 340 can include a dust pan nozzle 344 that can be in fluid communication with the docking port 382. Turning to FIG. 7, when the hand vacuum 300 is docked in the docking station 380, the dust pan nozzle 344 is in fluid communication with the hand vacuum 300. The suction motor (not shown) on the hand vacuum 300 can be actuated to draw airflow, as seen by arrows $A_I$, into the dust pan nozzle 344. In one example, the raised upper portion 350 of the foot pedal 352 can be actuated, or pressed, without depressing the foot pedal 352. Thus, the lid 370 can remain in the closed position, and debris can be drawn into the trash can 340 via the dust pan nozzle 344 rather than through the suction ports 360 (FIG. 6). A user may desire to manually sweep dirt or debris toward the dust pan nozzle 344 in order to facilitate drawing of debris into the dust pan nozzle 344.

Figure 8:
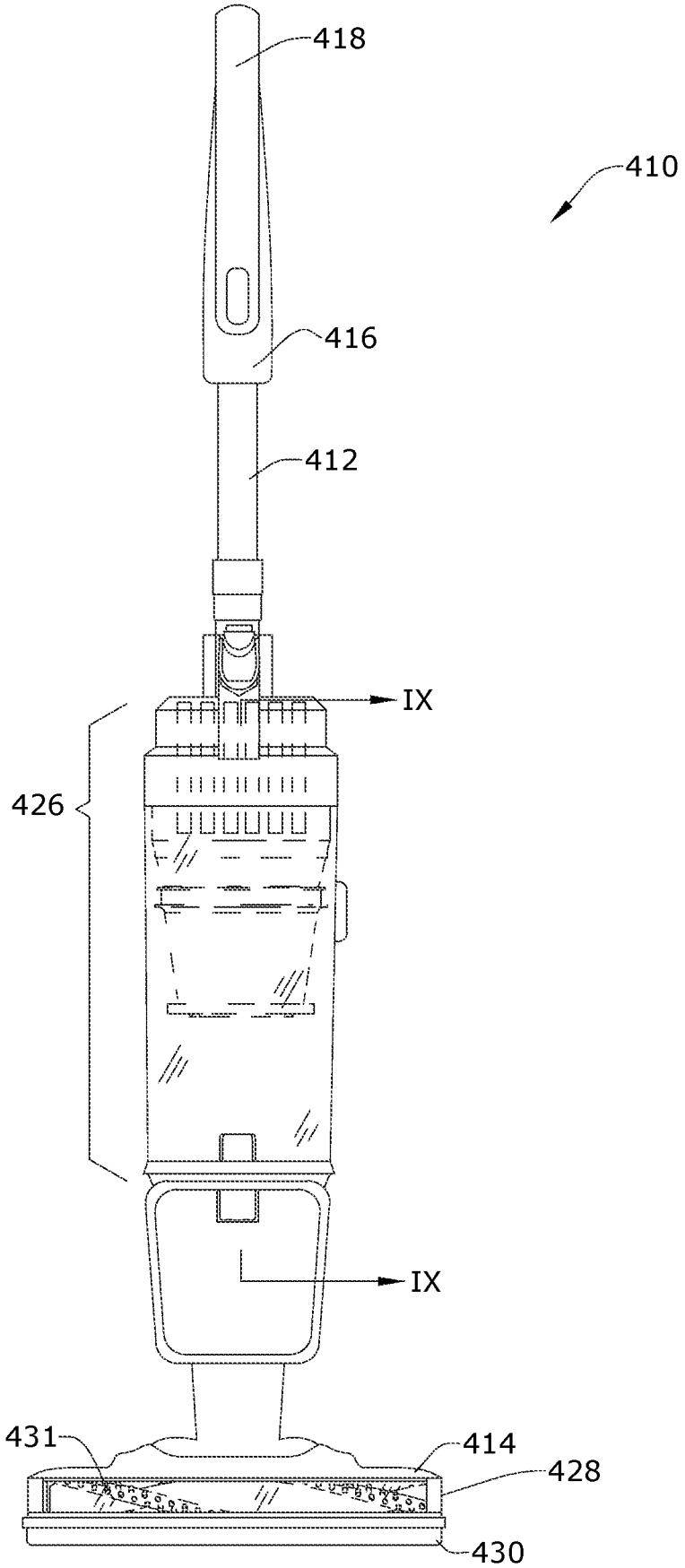
FIG. 8 is a front view of a vacuum cleaner having a separation module according to various aspects described herein.
Figure 9:
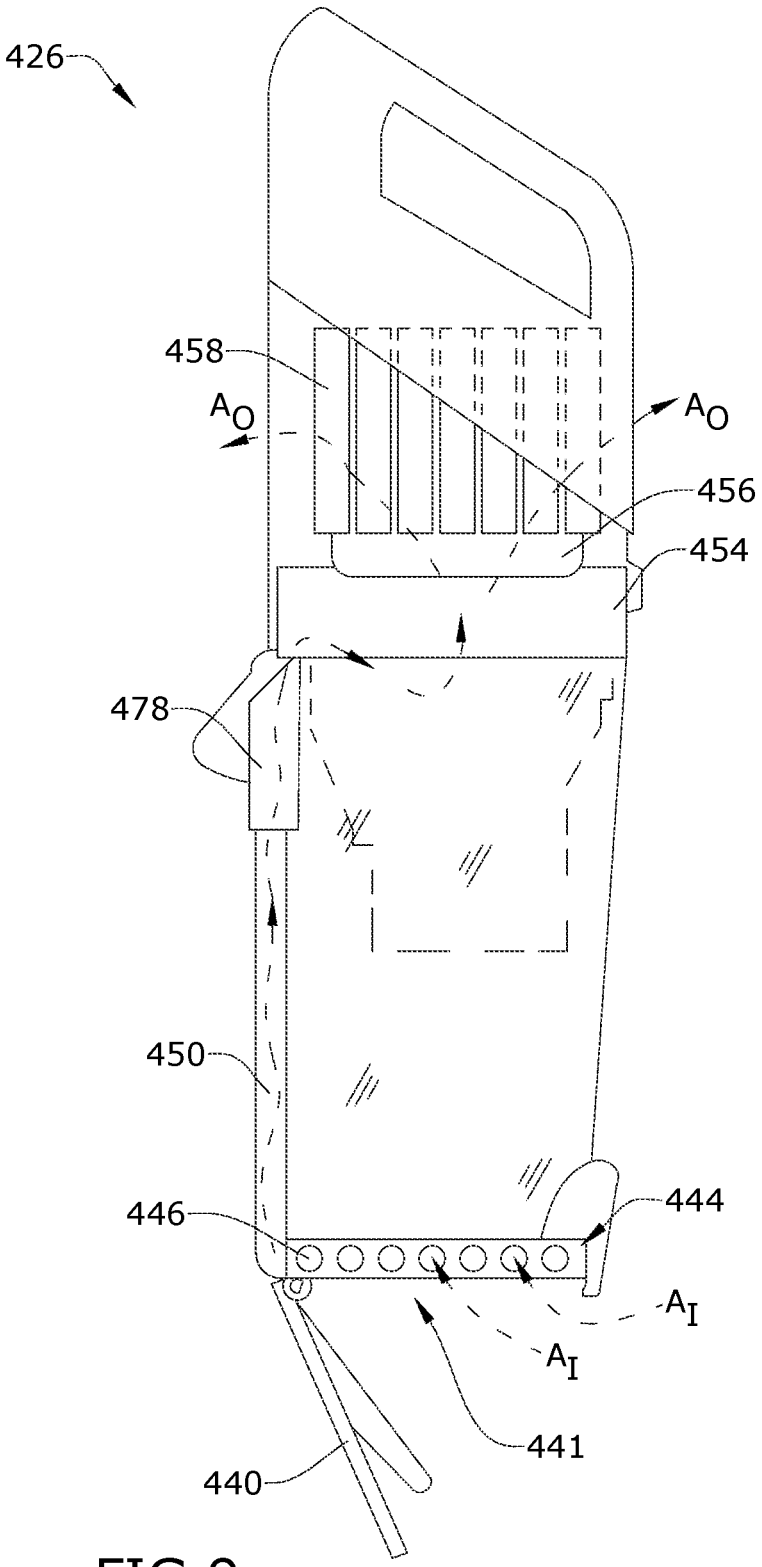
FIG. 9 is a schematic sectional view of the separation module taken through line IX-IX of FIG. 8.
Figure 10:
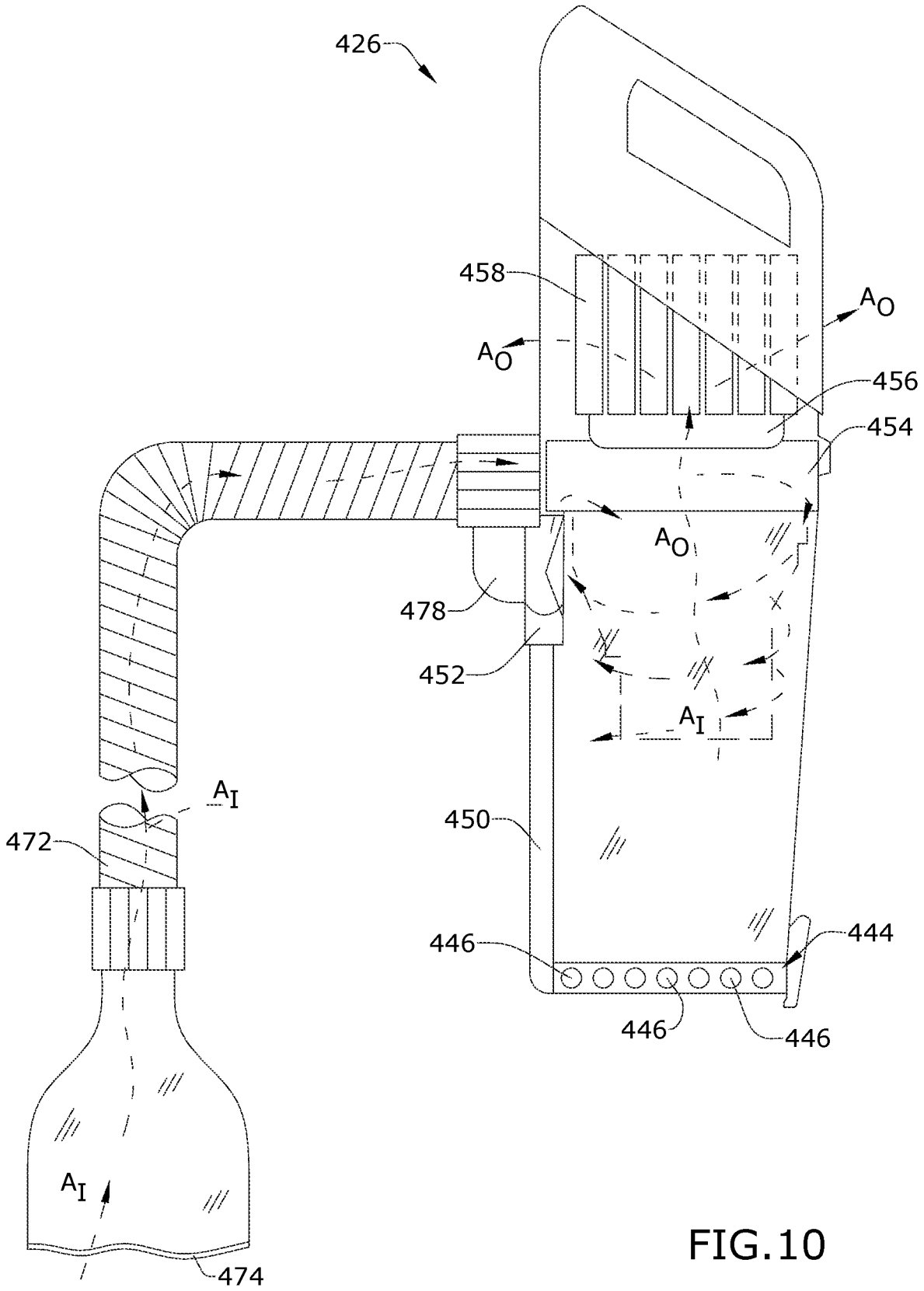
FIG. 10 is a schematic side view of the separation module of FIG. 8 with an accessory hose according to various aspects described herein.

FIGS. 8-10 show a vacuum cleaner 410 having a separation module 426 carrying a vacuum fan/motor assembly 456 therein. FIG. 8 is a front view of the vacuum cleaner 410 The vacuum cleaner 410 can include an upright handle assembly 412 pivotally mounted to a foot assembly 414. The handle assembly 412 can further include a primary support section 416 with a grip 418 on one end to facilitate movement by a user. With the vacuum fan/motor assembly 456 being carried on the separation module 426, the separation module 426 can be removed from the handle assembly 412 for use as a lift-off or hand carriable vacuum cleaning unit.

The foot assembly 414 can include a housing 428 with a suction nozzle 430 formed at a lower surface thereof and that is in fluid communication with the vacuum fan/motor assembly. An agitator 431 can be positioned within the housing 428 adjacent the suction nozzle 430 and operably connected to a dedicated agitator motor (not shown).

FIG. 9 is a schematic sectional view of the separation module 426 taken through line IX-IX of FIG. 8. The separation module 426 can include an air duct 450 and an airflow diverter 478. The airflow diverter 478 can direct suction from the vacuum fan/motor assembly 456 to a plenum ring 444 around a debris outlet 441 at the bottom of the separation module 426, rather than to the inlet 452 of the separation module 426. The plenum ring 444 can include a plurality of suction ports 446.

When the separation module 426 is removed from the upright handle assembly 412 and a bottom door 440 of the separation module 426 is opened, as illustrated in FIG. 9, the vacuum fan/motor assembly 456 can be energized. When the vacuum fan/motor assembly 456 is energized, airflow, as seen by arrows $A_I$, can be drawn into the air duct 450 via the suction ports 446. In one example, a battery pack 458 can energize the vacuum fan/motor assembly 456. In the event that a dust plume is created upon the opening of the door 440, dust or debris can be drawn into the air duct 450 where it can further be deposited into a pre-motor filter 454 and filtered air can flow out of the separation module 426, as seen by arrows $A_O$. A user may desire to remove the filter 454 periodically in order to wash the entrained debris away and clean the filter 454.

FIG. 10 is a schematic side view of the separation module 426 of FIG. 8 coupled with an accessory hose 472. The separation module 426 can optionally be removed from the upright handle assembly 412 for use as a portable or hand-carriable vacuum cleaning unit. In this case, an inlet 474 of the accessory hose 472 serves as the inlet to the airflow path through the vacuum cleaning unit. When the accessory hose 472 is coupled with the separation module 426 via the inlet 452, the airflow diverter 478 can direct airflow through the separation module 426 in the same manner that airflow is directed when the separation module 426 is coupled with the upright handle assembly 412, which is illustrated by arrows $A_I$. Airflow is further directed out of the separation module 426 once it has been filtered by the pre-motor filter 454, as seen by arrows $A_O$.

Figure 11:
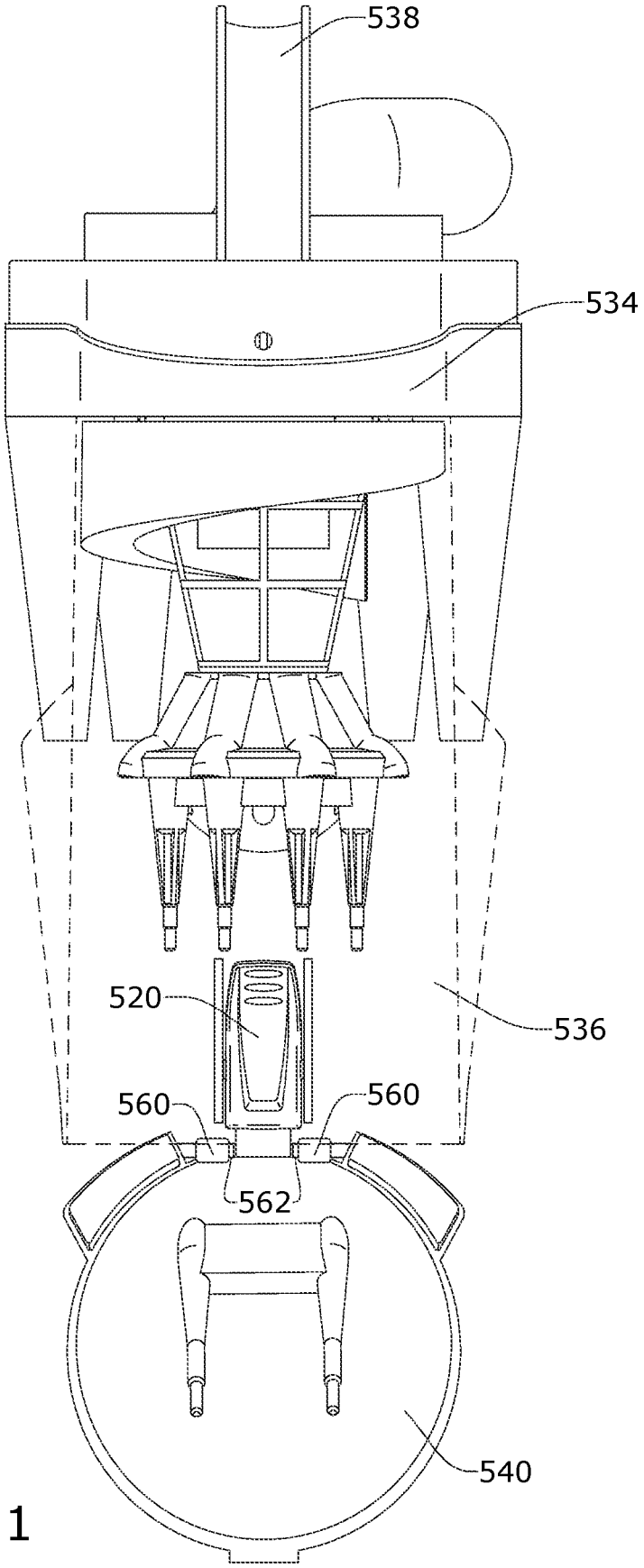
FIG. 11 is a front view of a vacuum cleaner separation module having dampers according to various aspects described herein.

FIG. 11 is a front view of a separation module 534 having dampers 560. The separation module 534 has a housing 536 with a carry handle 538 located on an upper portion thereof and a pivotally-mounted bottom door 540 that is attached to the lower end thereof by a hinge including hinge pins 562. A pivoting lever 520 releasably engages the bottom door 540 for selectively opening the bottom door 540 and emptying the housing 536, and can be provided opposite the hinge pins 562.

The hinge pins 562 are provided with the dampers 560, and slow down the opening speed of the door 540, which can result in the reduction of the amount of dust plume formation when emptying the module 534. The dampers 560 can be based on any suitable method of dampening, such as but not limited to friction or a viscous coupling.

The above described aspects provide for a variety of benefits, including a reduction of a dust plume when emptying separation modules. These features, alone or in combination, create a superior separation module for vacuum cleaners. Dust plumes can cause dust to be deposited onto a user or around an outside of trash can where a separation module is being emptied. Thus, one advantage that may be realized in the practice of aspects described herein is that a user can have a better experience while emptying a separation module due to the reduction of dust plume.

While the invention has been specifically described in connection with certain specific embodiments thereof, it is to be understood that this is by way of illustration and not of limitation. For example, auxiliary suction nozzles according to aspects described herein can be provided within any suitable separation module and vacuum cleaner. Furthermore, rotational dampers can be provided on any separator module door, not only a separator module as illustrated. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a suction nozzle;

a suction source fluidly connected to the suction nozzle and configured to create a working airstream; and a separation module configured for separating contaminants from the working airstream, the separation module, comprising:

a separation module housing selectively and releasably secured to a housing of the vacuum cleaner;

a door rotatably coupled to the separation module housing, wherein the door rotates between a closed position wherein the door at least partially defines a bottom surface of the separation module housing, and an opened position wherein debris can be emptied; and at least one damper operably coupled with the door and configured to reduce a speed of the door moving to the opened position as compared to an undamped door.

2. The vacuum cleaner of claim 1, further comprising a hinge including at least one hinge pin, wherein the door is rotatable about the at least one hinge pin.

3. The vacuum cleaner of claim 2 wherein the at least one damper interfaces with the hinge.

4. The vacuum cleaner of claim 2, further comprising a lever configured to releasably engage the door with the separation module housing.

5. The vacuum cleaner of claim 4 wherein the lever comprises a pivoting lever provided opposite the hinge.

6. The vacuum cleaner of claim 2, further comprising an auxiliary suction nozzle located adjacent at least a portion of a lower end of the separation module housing and adapted for ingesting debris.

7. The vacuum cleaner of claim 6 wherein the auxiliary suction nozzle is located about at least a portion of a perimeter of the lower end of the separation module housing.

8. The vacuum cleaner of claim 7 wherein the auxiliary suction nozzle is not located adjacent the hinge.

9. The vacuum cleaner of claim 7, further comprising an auxiliary suction fan assembly provided on the separation module housing and fluidly coupled with the auxiliary suction nozzle.

10. The vacuum cleaner of claim 9, further comprising a duct provided on a sidewall of the separation module housing, the duct fluidly coupling the auxiliary suction fan assembly and the auxiliary suction nozzle.

11. The vacuum cleaner of claim 9, further comprising a lever configured to releasably engage the door and wherein a fan of the auxiliary suction fan assembly is electrically coupled with the lever and a power switch for the fan is actuated when the door is released from the closed position via the lever.

12. The vacuum cleaner of claim 7 wherein the separation module further comprises a duct fluidly coupled between the auxiliary suction nozzle and the suction source.

13. The vacuum cleaner of claim 1, further comprising a carry handle located at an upper portion of the separation module housing and/or a latch mechanism provided with the separation module that releasably secures the separation module to the housing of the vacuum cleaner.

14. The vacuum cleaner of claim 1 wherein the at least one damper is provided between the separation module housing and the door.

15. A separation module configured for separating contaminants from a working airstream in a vacuum cleaner, the separation module, comprising:

a separation module housing configured to be selectively and releasably secured to a housing of the vacuum cleaner;

a carry handle provided on the separation module housing;

a door, pivotally-mounted to a lower end of the separation module housing, the door moveable between a closed position wherein the door at least partially defines a bottom surface of the separation module housing, and an opened position wherein debris can be emptied;

at least one damper operably coupled with the door, the at least one damper configured to reduce a speed of the door as the door moves to the opened position as compared to an undamped door; and a release mechanism configured to releasably engage the door with the separation module housing.

16. The separation module of claim 15, further comprising a hinge including at least one hinge pin, wherein the door is rotatable about the at least one hinge pin and the at least one damper is provided at the hinge.

17. The separation module of claim 16 wherein the at least one damper comprises multiple dampers.

18. The separation module of claim 17 wherein the at least one hinge pin includes at least two hinge pins, each of the at least two hinge pins having a corresponding damper.

19. The separation module of claim 16 wherein the release mechanism comprises a pivoting lever provided opposite the hinge.

20. The separation module of claim 15, further comprising an auxiliary suction nozzle located adjacent at least a portion of the lower end of the separation module housing and adapted for ingesting debris.

* * * * *